United States Patent [19]

Carr

[11] 3,949,502

[45] Apr. 13, 1976

[54] SALES DISPLAY AND METHOD FOR SELLING SELECTED MEAT CUTS

[76] Inventor: James E. Carr, 6038 S. Prince, Littleton, Colo. 80120

[22] Filed: Sept. 3, 1974

[21] Appl. No.: 502,818

[52] U.S. Cl. ..... 40/126 R; 428/21

[51] Int. Cl.[2] ..... G09F 19/00

[58] Field of Search ..... 40/1, 126, 126 R, 160, 40/136; 46/15, 18; 35/1, 49, 54; 312/114, 204; 428/14, 21

[56] References Cited

UNITED STATES PATENTS

| | | | |
|---|---|---|---|
| 1,962,465 | 6/1934 | Schoolcraft | 40/126 X |
| 2,360,362 | 10/1944 | Orosz | 40/1 |
| 2,513,290 | 7/1950 | Daly | 35/49 |
| 3,579,862 | 5/1971 | Ballen | 35/8 |

FOREIGN PATENTS OR APPLICATIONS

| | | | |
|---|---|---|---|
| 395,103 | 7/1933 | United Kingdom | 40/126 |

*Primary Examiner*—Louis G. Mancene
*Assistant Examiner*—Wenceslao J. Contreras
*Attorney, Agent, or Firm*—Ancel W. Lewis, Jr.

[57] ABSTRACT

A plurality of comparatively lightweight, nonperishable, three-dimensional fabricated replicas of selected primal cuts of meat and sub-cuts thereof that are displayed and identified in a store to attract the purchaser and for use in informing the purchaser about the various cuts of meat and the desirability and savings relative to the purchasing of each cut of meat.

3 Claims, 10 Drawing Figures

SALES DISPLAY AND METHOD FOR SELLING SELECTED MEAT CUTS

FIELD

This invention relates to sales displays and methods and more particularly to a novel sales display with replicas of selected cuts of meat and method for merchandising selected cuts of meats.

BACKGROUND

The purchasing public is relatively unaware and uninformed when it comes to the purchasing of cuts of meat. Present day practices in the sale and selection of cuts of meat result in losses to both the store owner and the retain purchaser. These practices include the sale of relatively large portions of the carcass such as either a side of beef which weighs on the order of 250 to 290 pounds. The price of these cuts per pound is comparatively low but the cutting loss of this would be on the order of 40 to 80 pounds, which waste consists of bones and fat. The other present practice is for the customer to purchase the small trimmed cuts on the order of several pounds that have been wrapped and placed on display at a relatively high price per pound. Between these large cuts and small cuts there are the primal cuts of meat, i.e., beef round beef sirloin, beef rib, beef chuck, and pork loin, that have a substantial part of the bone and fat removed and if purchased by the customer would provide a substantial savings to both the customer and the store. The present purchaser is generally uninformed as to the advantages of purchasing primal cuts of meat and is further uninformed as to what sub-cuts can be derived from each primal cut.

Accordingly, it is an object of the present invention to provide a novel sales display for merchandising cuts of meat and method for merchandising certain desirable cuts of meat in food stores.

Another object of this invention is to provide a sales display for and method of merchandising meat in which meat in general is brought to the attention of the customer as well as the desirability of purchasing certain primal cuts as well as to enhance the sale of meat.

Yet a further object of the present invention is to provide a sales display and method for merchandising selected cuts of meat wherein relatively lightweight, three-dimensional, non-perishable replicas of primal cuts of beef and/or pork are displayed in a store, preferably adjacent a meat counter with indicia identifying each cut of meat and with replicas of certain sub-cuts of meat associated with the primal cuts to attract and inform the customer and thereby benefit both customer and seller.

Other objects, advantages and capabilities of the present invention will become more apparent as the description proceeds taken in conjunction with the accompanying drawings, in which.

Figure 1:
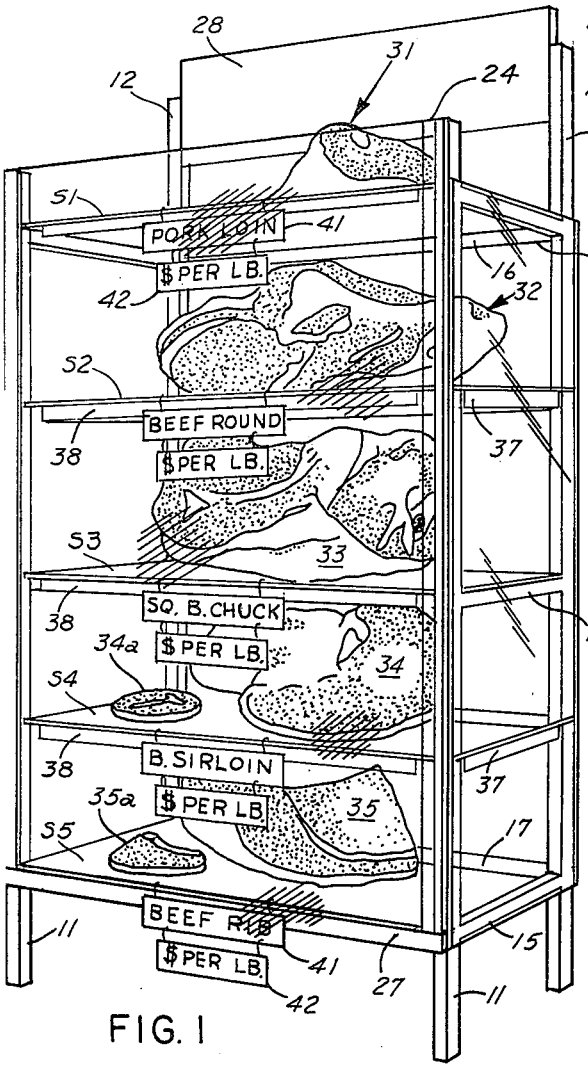
FIG. 1 is a perspective view of a display of five replicas of primal cuts of meat and illustrative sub-cuts supported by a display case in accordance with the present invention.
Figure 2:
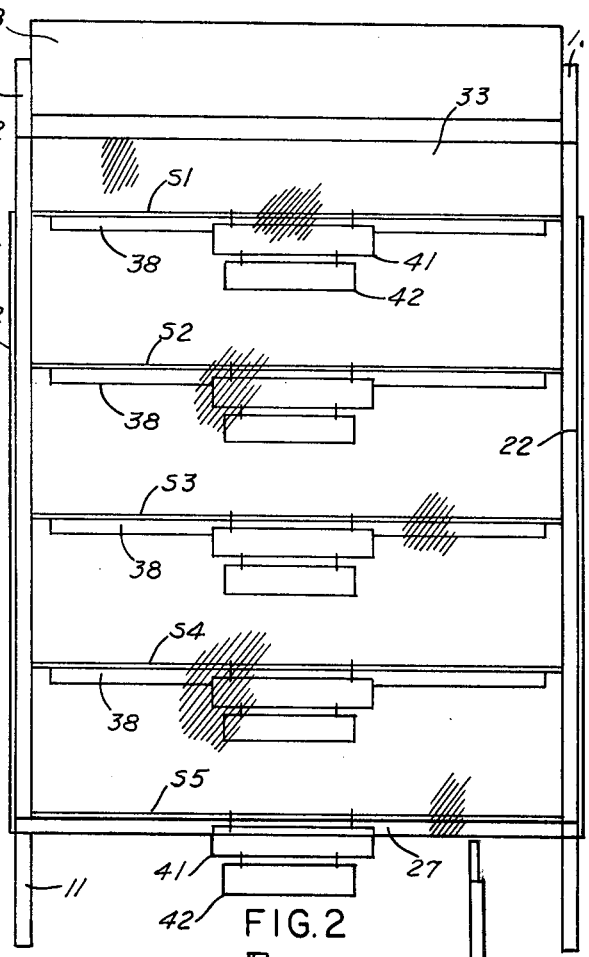
FIG. 2 is a front elevation view of the display case of FIG. 1 with the replicas removed.
Figure 3:
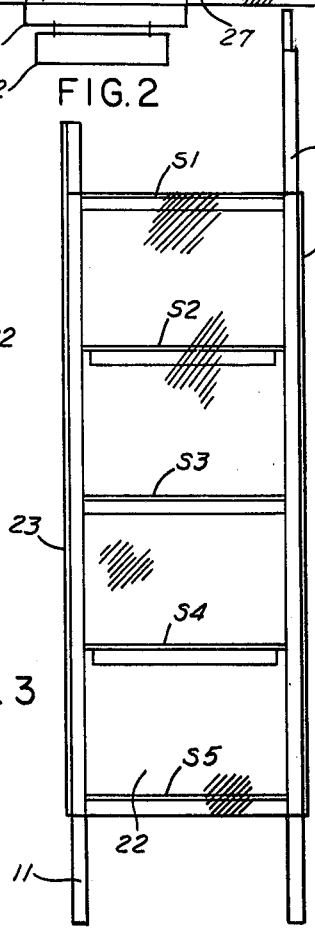
FIG. 3 is a side elevation view of the display case of FIG. 1 with the replicas removed.
Figure 4:
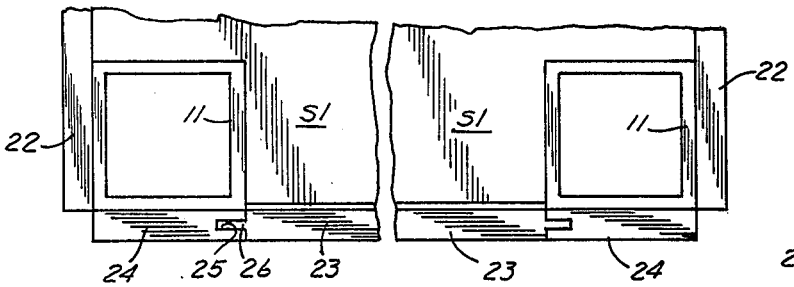
FIG. 4 is a top plan view of a portion of the display case illustrating the sliding feature of the front closure panel.
Figure 5:
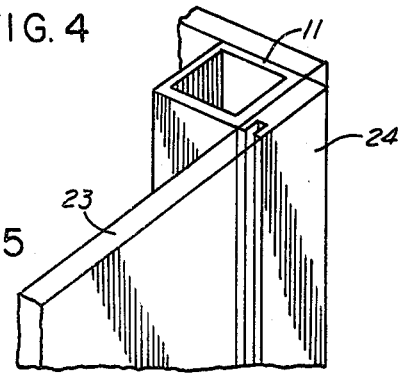
FIG. 5 is a fragmentary perspective view of an upper corner of the display case of FIGS. 1 through 4.
Figure 6:
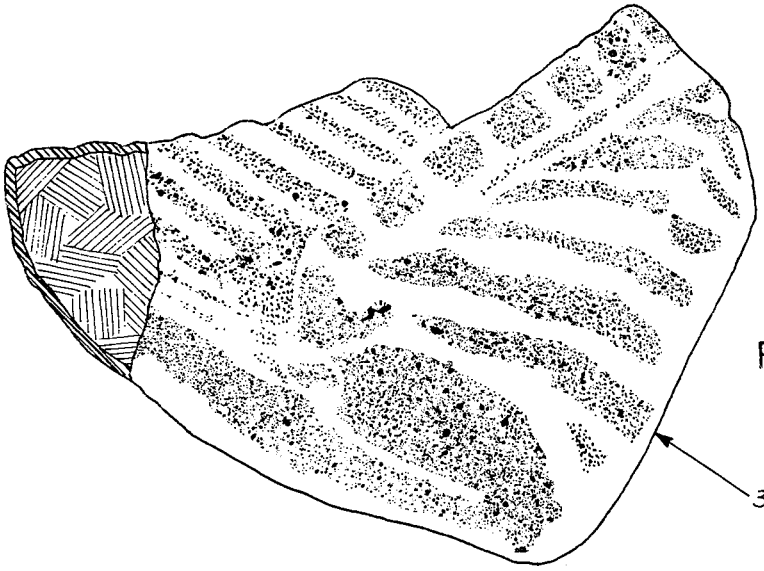
FIG. 6 is a perspective view of the beef rib replica of FIG. 1 with a portion broken away to show construction.

Referring now to FIGS. 1 through 5, there is shown a closed display case having a rigid frame inclusive of a pair of similar front vertical corner rods 11 and a pair of similar rear vertical corner rods 12 in spaced parallel relation together with a horizontal upper side rod 13, horizontal intermediate side rod 14 and horizontal lower side rod 15 connected between each of the front and rear corner rods 11 and 12 and a horizontal upper back rod 16 and a horizontal lower back rod 17 connecting the rear corner rods 12. These rods making up the frame are preferably fabricated of hollow metal tubing having a square cross section and welded at the connected ends to provide a strong framework that does not materially detract from the items being displayed.

A total of five shelves, S1, S2, S3, S4 and S5 proceeding from top to bottom are supported on the frame at vertically spaced intervals. The upper shelf S1 rests on the upper side rods 13 and upper back rod 16, an intermediate shelf S3 rests on intermediate side rids 14 and the lower shelf S5 rests on the lower side rods 15 and a lower back rod 17. Shelves S2 and S4 are supported on rests (not shown) suitably affixed to the vertical corner rods 11 and 12 which facilitate the placement of the shelves thereon.

The shelves S1 through S5 are made of transparent plexiglass and for added strength a side reinforcing strip 37 made of plexiglass is provided along the underside of each side and a front reinforcing strip 38 is provided along the underside of the front of each shelf. A back cover plate 21 covers the back of the display case while side cover plates 22 cover both sides thereof. Again, these cover plates are preferably made of a transparent plexiglass or the like. The front of the case is shown as being closed with a vertically sliding front door 23 that projects a substantial distance above the upper shelf S1. The front door 23 is held along the sides with a pair of parallel spaced front face plates 24, each having an inside groove 25 and the door is provided with a tongue 26 along both side edges each tongue 26 being complementary in shape to the associated groove 25 and freely slidable therein. A bottom plate 27 extending between the front vertical corner rods 11 provides a stop or rest for establishing the lower limit and support for the front door 23. A display panel 28 is mounted across the back above the top shelf between the vertical rear corner rods 11 which projects above the top of the sliding door.

On the upper shelf S1 there is supported a whole pork loin replica 31. On the next shelf S2 there is supported a beef round replica 32. On the third shelf S3 there is supported a square beef chuck replica 33. On the forth shelf S4 there is supported a beef sirloin replica 34 and on the fifth shelf S5 there is supported a beef rib replica 35. It is noted that the only replica that is not entirely enclosed in the case is the whole pork loin replica 31 but this is protected across the front. The purpose of a closed or partially closed display case is to prevent viewers and particularly children from handling the replicas for obvious reasons.

Associated with the upper shelf S1 there is a sign 41 with indicia identifying the pork loin replica 31 and a further sign 42 indicating the price per pound. Each successive shelf has similar signs to inform the purchaser as to each specific cut of meat supported on that shelf.

Figure 7:
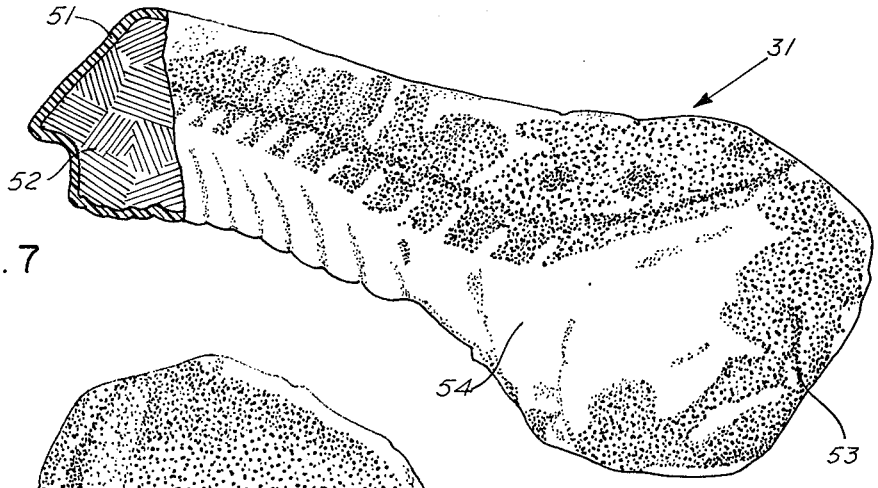
FIG. 7 is a perspective view of the whole pork loin replica of FIG. 1 with a portion broken away to show construction.
Figure 8:
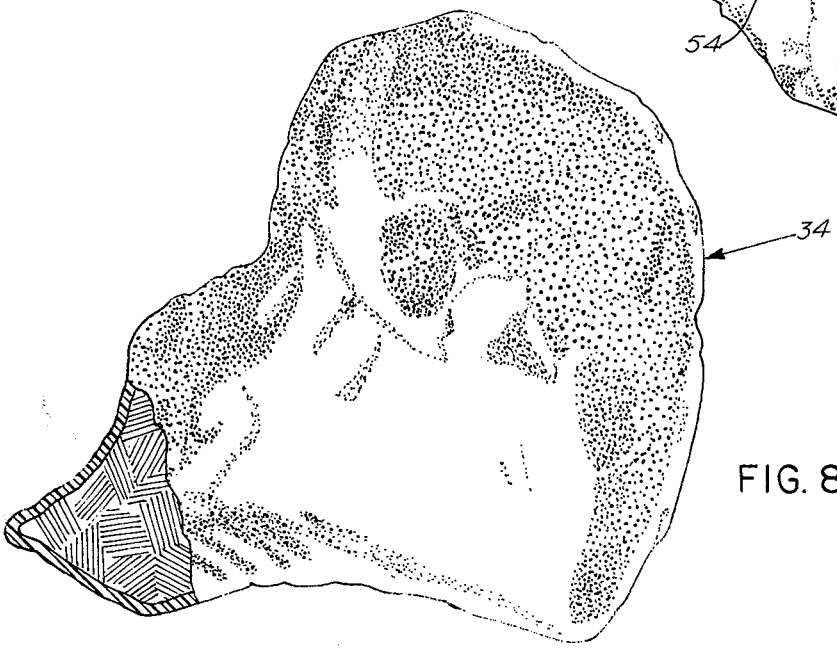
FIG. 8 is an enlarged perspective view of the beef sirloin replica of FIG. 1 with a portion broken away to show construction.
Figure 9:
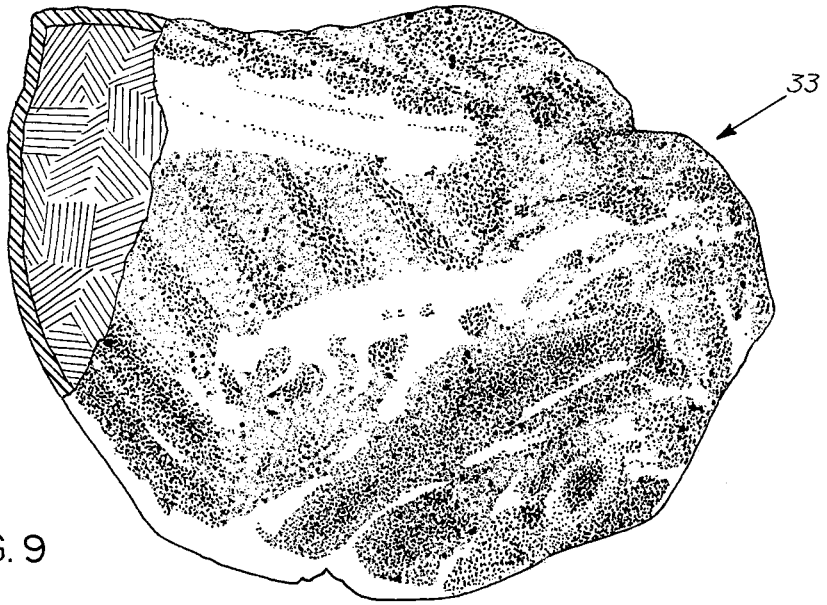
FIG. 9 is an enlarged perspective view of the beef chuck replica of FIG. 1 with a portion broken away to show construction.
Figure 10:
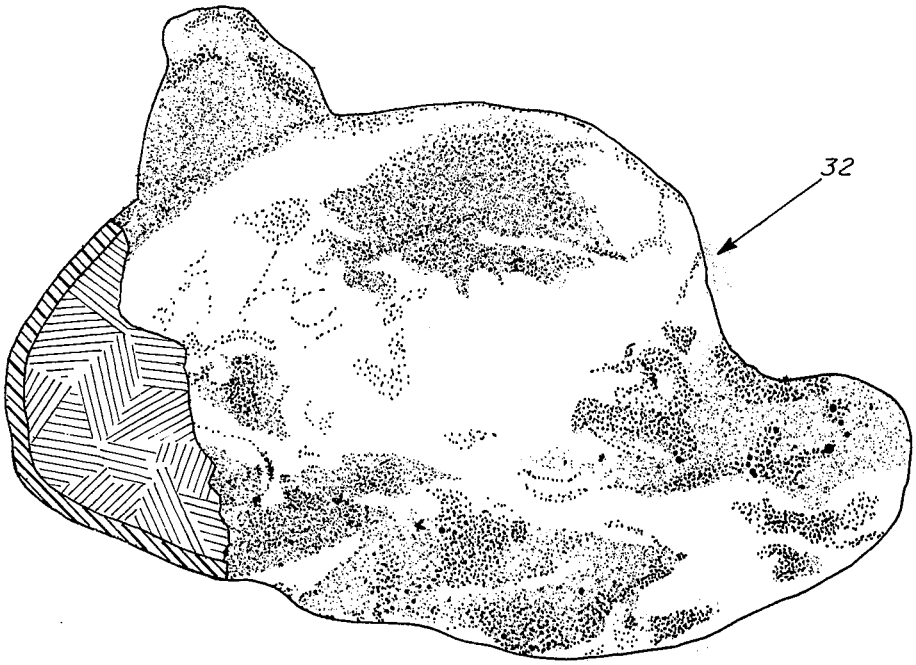
FIG. 10 is an enlarged perspective view of the beef round replica shown in FIG. 1 with a portion broken away to show construction.

Referring now to FIG. 7, there is shown in more detail the pork loin replica 31. This replica is in the form of a thin-walled hollow body 51 with an interior cavity 52 preferably made of fiber glass material or the like so as to be light in weight as compared to the actual cut of meat and to be non-perishable. The body has areas painted with red paint simulating the meat that are represented at 53, and unpainted areas that are clear at 54 showing the exterior of the fiber glass body that simulate the bone and fat so that the replica closely resembles the actual cut of meat but again is much lighter in weight and non-perishable.

In the construction of the replicas shown and described herein, the original mold is made in plaster which is a negative complement shaped on the inside by covering an actual cut of meat with the plaster material. The mold is then seperated into several pieces. These mold pieces are made into a top half and a bottom half. The inside of the mold is then coated with an opaque gel coat and a polyester resin is painted on the inside of the mold and reinforced with a fiber glass mat. A resin is then painted over the mat in the mold. The fiber glass sets up and the mold is then broken away and the body is in several pieces which are then joined together to form the unitary bodies shown in the drawings. The resulting product is then painted as above described. Alternative procedures for forming the replicas include injecting heated vinyl into a spinning mold such as an aluminum mold.

Of particular significance is that the present invention can be displayed in an area of the store where meat is sold and not only attract customers to purchase meat in general but also inform customers concerning the desirability of buying certain cuts such as the primal cuts and the particular sub-cuts of meat that can be derived from a primal cut which afford advantages in the customer getting choice cuts of meat for a more reasonable price. Moreover, from these primal cuts certain desirable sub-cuts are readily displayed to further enhance the sale of the primal cuts and sub-cuts of selected sizes and shapes.

In this connection, a chart showing the various sub-cuts may be associated with the display case. For example, the typical sub-cuts available from the primal cuts shown are as follows:

- Whole Pork Loin
  - Pork Loin Roast
  - Tenderloin Chops
  - Center Cut Chops
  - Rib End Chops
  - Southern Style Ribs
- Beef Round
  - Rump Roast
  - Sirloin Tip Steak
  - Round Steak
  - Swiss Steak
  - Heel of Round Roast
  - Stew Meat
  - Ground Beef
  - Soup Bones
- Beef Sirloin
  - Sirloin Steak
  - T-Bone Steak
  - Ground Beef
- Beef Rib
  - Short Ribs
  - Rib Roast
  - Rib Steaks
  - Ground Beef
- Square Beef Chuck
  - Arm Roast
  - Swiss Steak
  - Chuck Blade Roast
  - Chuck Steak
  - English Roast
  - Stew
  - Soup Bones
  - Ground Beef In the sale of the above primal cuts and associated sub-cuts a typical purchase order form would be provided for each primal cut listing the sub-cuts with a column for thickness and cost per package.

In this connection, one or more sub-cut replicas may be provided on the display stand beside the associated primal cut replicas to further give a three-dimensional illustration of what types of sub-cuts may be available. A rib steak replica **35*a* is shown on shelf S5 and a T-bone steak replica 34*a*** is shown on shelf S4.

The present invention contemplates the provision of a complete kit which would include the display stand with suitable signs identifying and sales information on panel 28, the replicas, meat cut charts and order forms.

From the foregoing, it should be appreciated that the present invention using replicas of primal cuts of meat affords substantial advantages to both the store and customer. The display will obviously attract customers to the meat department increasing sales while at the same time the customer is informed as to the nature of these cuts and the economic advantages of purchasing certain choice cuts. The stores have the added advantage in that the primal cuts are readily derived from the carcasses furnished them with a minimum of labor and the customer is clearly informed as to the nature of their purchase and the sub-cuts that can be derived. In this connection, the replicas could be furnished with lines showing possible sub-cuts or with replicas made of sub-cut parts that could be assembled and disassembled to further illustrate the possibilities available by purchasing one of the primal cuts.

Although the present invention has been described with a certain degree of particularity, it is understood that the present disclosure has been made by way of example and that changes in details of structure may be made without departing from the spirit thereof.

What is claimed is:

1. In a display for use in merchandising selected primal cuts of meat, the combination comprising:

a plurality of three-dimensional, relatively lightweight, non-perishable replicas of primal cuts of meat including beef round, beef sirloin, beef rib, beef chuck and pork loin, each of said replicas being made of a fiber glass material formed as a hollow, generally thin-walled body that is of substantially less total weight than a corresponding cut of meat, each of said replicas being painted to represent alternately fat and meat to closely simulate the actual cut of meat;

support means for displaying the replicas, said support means being in the form of a display case having a plurality of vertically spaced transparent shelves with a different replica being supported on each shelf, a sub-cut replica of a construction corresponding with that of said primal cut replicas on at least one of said shelves representing a smaller cut of meat taken from the associated primal cut replica supported on an associated shelf, said display case being closed across the front, sides and rear with a transparent closure to enclose all of said replicas except the one on the uppermost of said shelves; and indicia means in the form of at least one sign associated with each shelf identifying each of the primal cut replicas and the price per pound of actual cuts of meat corresponding to said primal cut replicas.

2. In a display for use in merchandising primal cuts of meat, the combination comprising:

a plurality of three-dimensional relatively lightweight replicas of the primal cuts of meat including beef round, beef sirloin, beef rib, beef chuck and pork loin, each of said replicas being made of a fiber glass material formed as a hollow, generally thin-walled body of substantially less weight than a corresponding meat cut;

a display rack for displaying said replicas, said display rack including a frame having a pair of front and a pair of rear vertical corner rods and spaced side rods connecting the end rods;

a plurality of vertically spaced, transparent shelves on the frame with a replica supported on each shelf, said display rack having front, side and rear transparent panels closing the replicas therein except for the replica on the uppermost shelf to isolate them from exterior access during display;

a sub-cut replica of a construction corresponding with said primal cut replica on at least one of said shelves representing a smaller cut of meat taken from the primal cut replica supported on an associated shelf; and a sign associated with each primal cut replica to identify the corresponding cut and the cost per pound of that corresponding cut, said front door along opposite side edges and said frame at opposite corners having cóoperative tongue and groove portions to facilitate the sliding of the front door relative to the frame, said rods being made of metal tubing welded at the connections and said panels being made of plexiglass.

3. In a method of merchandising selected primal cuts of meat, the steps of:

providing a plurality of three-dimensional replicas of selected primal cuts of meat made of a fiber glass material formed as a hollow, generally thin-walled body that is of substantially less total weight than a corresponding cut of meat;

displaying each of said replicas at different elevations in a transparent enclosure;

providing at least one replica of a smaller cut of meat in association with each primal cut; and providing indicia to identify each primal cut of meat and the price per pound of a corresponding cut of meat.

* * * * *